US009899732B2

(12) United States Patent
Urcia, Jr. et al.

(10) Patent No.: US 9,899,732 B2
(45) Date of Patent: Feb. 20, 2018

(54) STRUCTURAL RECONFIGURABLE ANTENNA

(71) Applicant: The Boeing Company, Chicago, IL (US)

(72) Inventors: Manny S. Urcia, Jr., Wildwood, MO (US); Alec Adams, Woodway, WA (US); Edward V. White, St. Charles, MO (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/342,094

(22) Filed: Nov. 2, 2016

(65) Prior Publication Data

US 2017/0237157 A1 Aug. 17, 2017

Related U.S. Application Data

(63) Continuation-in-part of application No. 15/043,826, filed on Feb. 15, 2016, now abandoned.

(51) Int. Cl.

| | |
|---|---|
| ***H01Q 21/22*** | (2006.01) |
| ***H01Q 1/36*** | (2006.01) |
| ***H01Q 1/28*** | (2006.01) |

(52) U.S. Cl.
CPC ..... *H01Q 1/364* (2013.01); *H01Q 1/286* (2013.01); *H01Q 21/22* (2013.01)

(58) Field of Classification Search
CPC ..... H01Q 1/364; H01Q 21/22; H01Q 1/286
See application file for complete search history.

(56) References Cited

U.S. PATENT DOCUMENTS

2009/0322646 A1 12/2009 Dreina et al.

FOREIGN PATENT DOCUMENTS

| | | | |
|---|---|---|---|
| EP | 2328232 | A1 | 6/2011 |
| WO | 2014197707 | A2 | 12/2014 |

OTHER PUBLICATIONS

Search Report for related European Application No. EP17155289.6; report dated Jul. 10, 2017.
Michael D. Dickey; Emerging Applications of Liquid Metals Featuring Surface Oxides; Applied Materials & Interfaces 2014; pp. 18369-18379.
Mohammad Rashed Khan, Collin B. Eaker, Edmond F. Bowden, and Michael D. Dickey; Giant and Switchable Surface Activity of Liquid Metal via Surface Oxidation; PNAS; Sep. 30, 2014; vol. 111 No. 39; pp. 14047-14051.
Mohammad R. Khan, Chris Trlica, and Michael D. Dickey; Recapillarity: Electrochemically Controlled Capillary Withdrawal of a Liquid Metal Alloy from Microchannels; Materials Views, Advanced Functional Materials; pp. 1-8.

*Primary Examiner* — Andrea Lindgren Baltzell
(74) *Attorney, Agent, or Firm* — Miller, Matthias & Hull LLP

(57) ABSTRACT

A reconfigurable antenna is provided having a liquid metal in contact with an electrolyte with the liquid metal being in a first configuration. A plurality of electrodes includes a first electrode in contact with the liquid metal and a second electrode in contact with the electrolyte. A voltage source connected across the first and second electrodes applies a voltage of a predetermined magnitude and a predetermined polarity in order to move the liquid metal from the first configuration to a second configuration and to measure resultant current flow and modify the applied voltage based on the resultant current flow. Cessation of the applied voltage locks the liquid metal in this second configuration.

23 Claims, 7 Drawing Sheets

STRUCTURAL RECONFIGURABLE ANTENNA

CROSS-REFERENCE TO RELATED APPLICATION

This application is a continuation-in-part application that is based on and claims priority to U.S. Patent Non-Provisional application Ser. No. 15/043,826, filed on 15 Feb. 2016, with the United States Patent and Trademark Office, the disclosure of which is hereby incorporated by reference in its entirety.

TECHNICAL FIELD

The present disclosure is related generally to electromagnetic wave communications, and, more particularly, to a system and method for dynamically reconfiguring one or more electromagnetic wave antennae to accommodate different format or performance requirements.

BACKGROUND

An antenna is a structure used to transmit or receive electromagnetic radiation, typically for communication or detection purposes. Thus, for example, cellular band antennae are ubiquitous on the upper and side surfaces of buildings in populated areas, and the red aviation warning lights of radio station antennae towers dot the countryside. Since the radiation transmission and reception characteristics of an antenna are largely a function of the antenna's size and shape (configuration), the antennae we see every day take on a wide variety of shapes and sizes.

While the present disclosure is directed to a system that can eliminate certain shortcomings, it should be appreciated that such a benefit is neither a limitation on the scope of the disclosed principles nor of the attached claims, except to the extent expressly noted in the claims. Additionally, the discussion of technology in this Background section is reflective of the inventors' own observations, considerations, and thoughts, and is in no way intended to accurately catalog or comprehensively summarize the art currently in the public domain. As such, the inventors expressly disclaim this section as admitted or assumed prior art. Moreover, any identification or implication above or otherwise herein of a desirable course of action reflects the inventors' own observations and ideas, and should not be assumed to indicate an art-recognized desirability.

SUMMARY

In keeping with an embodiment of the disclosed principles, a selectively reconfigurable antenna system is provided having a first material layer and a second material layer defining a cavity there between. A first reservoir at least partially contains a liquid metal and a second reservoir least partially contains a liquid electrolyte. The liquid metal and the electrolyte are in contact at a metal oxide layer in the cavity. A plurality of electrodes include a first electrode in contact with the liquid metal and a second electrode in contact with the electrolyte such that the metal oxide layer breaks down when a negative potential is applied to the second electrode relative to the first electrode.

In another embodiment, a method is provided for configuring an antenna. A liquid metal and an electrolyte are placed between two surfaces such that the liquid metal and the electrolyte are in contact with each other at an interface layer. A voltage applied between the electrolyte and a portion of the liquid metal operates to move the portion of the liquid metal toward the electrolyte. Stopping (or ceasing) the application of voltage when the liquid metal reaches a predetermined configuration locks the liquid metal in that configuration.

In yet another embodiment of the described principles, a reconfigurable antenna is provided having a liquid metal in contact with an electrolyte, with the liquid metal being in a first configuration. A plurality of electrodes include a first electrode in contact with the liquid metal and a second electrode in contact with the electrolyte. A voltage source is connected across the first and second electrodes and is configured to apply a voltage of a predetermined magnitude and a predetermined polarity in order to move the liquid metal from the first configuration to a second configuration.

Other features and aspects of embodiments of the disclosed principles will be appreciated from the detailed disclosure taken in conjunction with the included figures.

BRIEF DESCRIPTION OF THE SEVERAL VIEWS OF THE DRAWINGS

While the appended claims set forth the features of the present techniques with particularity, these techniques, together with their objects and advantages, may be best understood from the following detailed description taken in conjunction with the accompanying drawings of which:

DETAILED DESCRIPTION

Before presenting a fuller discussion of the disclosed principles, an overview is given to aid the reader in understanding the later material. As noted above, antennae are used for many purposes and for many different portions of the electromagnetic spectrum, from microwaves to consumer band radio, both AM and FM, up to long wavelength radio. These uses cover wavelengths across about 8 orders of magnitude. However, even within a narrow band of use, such as FM radio, different antenna designs may be needed to fully accommodate the relevant portion of the spectrum. For example, cellular communications and WiFi communications use approximately adjacent portions of the spectrum but typically benefit from differently tuned antennae.

Other contexts also often provide a benefit through tuned or customized antenna shapes. For example, monopoles, dipoles, Vivaldis, Patch antennae and Bow-tie antennae all rely on specific antenna shapes for their functions. The different antenna shapes alluded to above can certainly be produced today, but once made they are typically limited to their as-produced form. This means that in order for the underlying radio system to be used for another type or degree of use, an entirely new antenna or antenna array is needed.

However, in an embodiment of the disclosed principles, an electronically reconfigurable antenna system allows the configuration or reconfiguration of an antenna in the field whenever needed and however often needed. Thus, for example, a linear antenna may be lengthened or shortened, cross members may be created, configured, or eliminated, and planar antenna structures can be changed in shape and extent, all while the antenna system remains deployed.

Gallium forms a eutectic alloy with Indium to create a metal (EGaIn) with an essentially room temperature melting point. However, Gallium and its alloys have not typically been used in room temperature liquid metal electronic applications because Gallium forms an oxide skin almost instantaneously when exposed to oxygen. Thus, despite its high toxicity, Mercury has instead been long employed to meet most room temperature liquid metal requirements.

However, the Gallium oxide layer has the benefit that it imparts structural stability to the alloy when it is formed into a given shape. Moreover, the oxide layer can be broken down via the application of an electric field, allowing the EGaIn to be reconfigured. In an embodiment of the disclosed principles, an electrode array is employed to address and steer the liquid EGaIn into different two-dimensional and limited three-dimensional configurations.

Figure 1:
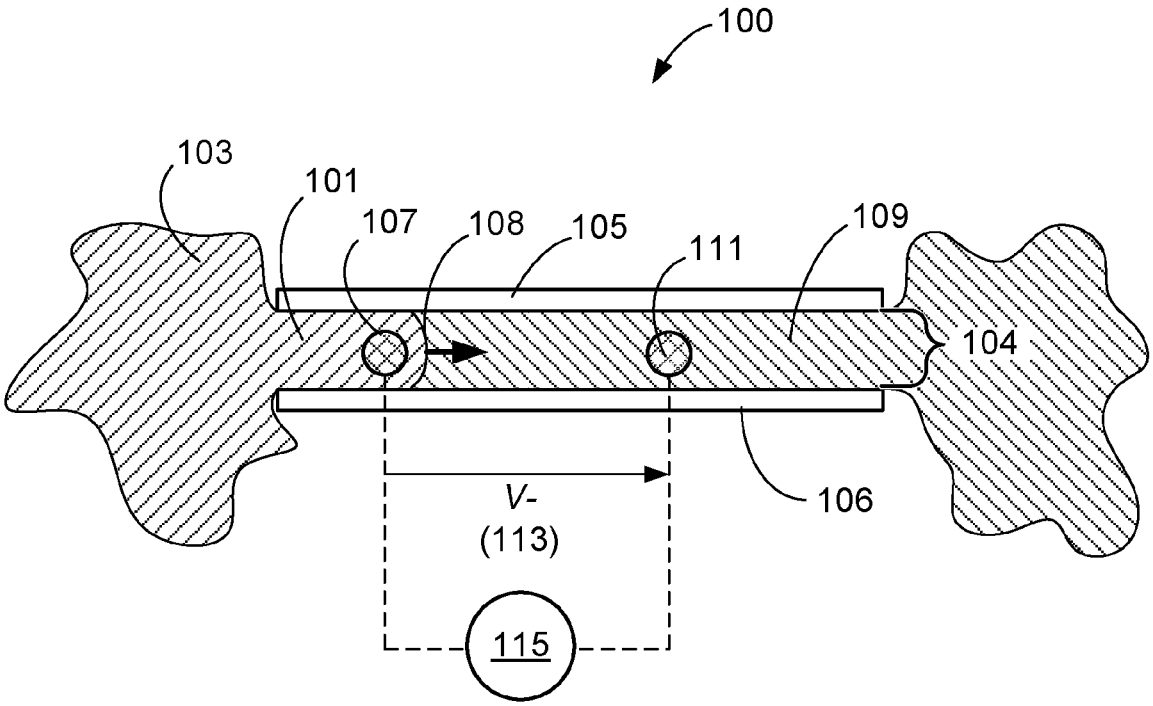
FIG. 1 is a plan view schematic showing a liquid metal configuration in a one-dimensional channel via the application of voltage having a selected magnitude and polarity.

With this overview in mind, and turning now to a more detailed discussion in conjunction with the attached figures, FIG. 1 shows a simplified view of one "pixel" 100 of the described liquid metal antenna system. As can be seen, the liquid metal (e.g., a eutectic alloy of Gallium and Indium, EGaIn) 101 is initially located in a source reservoir 103 and in a channel 104 formed by an upper surface 105 and a lower surface 106 over a first electrode 107. The remainder of the channel 104 is filled with an electrolyte 109, (e.g., sodium hydroxide, NaOH). A second electrode 111 is located in the channel 104 beyond the first electrode 107. The liquid metal reservoir 103 or a similar reservoir for the electrolyte may contain controlled ports to control the introduction or withdrawal of the associated liquid.

Figure 2:
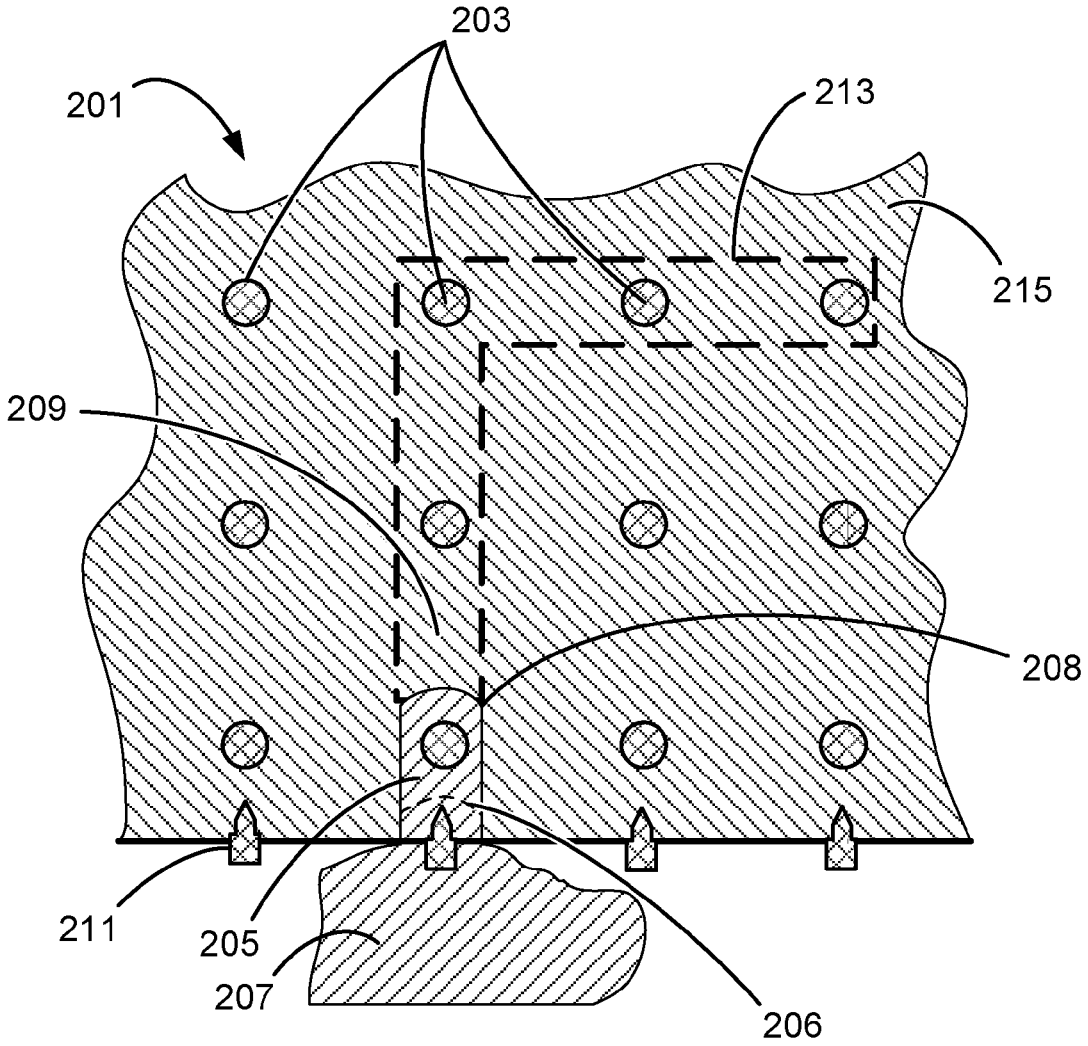
FIG. 2 is a plan view schematic of a two dimensional reconfigurable antenna in accordance with an embodiment of the disclosed principles.

Turning to FIG. 2, in order to reconfigure the liquid metal 205 away from its first configuration 206, a voltage V-113 (also referred to as a bias or potential difference) is applied by a voltage source 115 between the first electrode 107 and the second electrode 111. The conductive path between the first and second electrodes 107, 111 includes a portion of the electrolyte 109, 209 and a portion of the liquid metal 101, 205. The application of voltage 113 induces an electrical field across the oxide interface layer 108 at the point in the conduction path where the liquid metal 101 meets the electrolyte 109. The electrical field breaks down the oxide layer and raises the surface tension, causing the liquid metal to flow toward the lower voltage, forming a second configuration 208. While the breakdown of the oxide layer is a progressively variable phenomenon with variations in voltage 113, it has been found that an applied voltage V-113 of −0.5V causes observable deformation of the metal in the EGaIn/NaOH system described above, and that an applied voltage 113 of −1.5 V causes not only observable deformation but also significant movement of the metal. The applied potential 113 drops primarily across the oxide interface since the metal is highly conductive, although the NaOH is much less so.

If the applied voltage 113 is negative, with the potential at the first electrode 107 being higher than the potential at the second electrode 111, then the liquid metal will flow toward the second electrode 111. Otherwise, the liquid metal will flow back toward the first electrode 107.

It will be appreciated that the extent to which the liquid metal flows is largely determined by the magnitude of the applied voltage. Within a scale of movement of 1 to 2 millimeters, a voltage of −1.5V is sufficient to cause movement of the metal without leading to excess current consumption. A voltage of −0.5 would still generally cause movement of the metal, but may be too low in some cases to reliably override other influences on the metal, e.g., gravity in static arrays and inertia in moving arrays.

Higher or lower voltage levels than −1.5V may also be used depending upon electrode spacing (e.g., more than or conversely less than 1-2 mm), since it is the local electric field and not the overall voltage differential that impacts the EGaIn oxide layer. As noted above, NaOH is less conductive than EGaIn, so while the applied voltage drops primarily across the oxide interface, there will be some voltage drop in the NaOH over distance. Thus, while −1.5V between electrodes is sufficient for small movements such as 1-2 mm, higher voltages such as 5V may be beneficial for centimeter scale movements between two electrodes.

Continuing with FIG. 2, the array 201 includes a plurality of electrodes 203 in a flat regular array. Each electrode 203 is individually addressable to induce movement in the liquid metal 205, which is again drawn from a liquid metal reservoir 207. Similarly, an electrolyte 209 such as NaOH is present in the array 201 and is drawn from and returns to an electrolyte reservoir 215, which may be outside of or within the cavity 104.

In general, the liquid metal antenna is designed to affect a radiation pattern, radiation direction, electrical length, center frequency, one or more side lobes, a gain, a scan angle or polarization. The antenna formed in this manner may be driven during operation by one or more edge connectors 211, e.g., at the periphery of the array 201. The edge connectors 211 may be elongate with a slightly pointed tip as shown in order to pierce the oxide layer of the liquid metal and remain in good contact. In the event that a plurality of such edge connectors 211 are linked to the antenna, the driving device may determine which connector 211 exhibits the best matched impedance and lowest loss and may drive the antenna via that connector 211. In an embodiment, the edge connectors 211 are attached to one layer of the channel, e.g., layer 105, while the remaining contacts 203 are attached to the other layer, e.g., layer 106.

In addition, where multiple antenna structures rise from a common edge, a continuous strip of liquid metal along that edge may be used as an interconnection between the antenna structures. Moreover, one or more antenna structures may be driven from connectors on different edges, e.g., top and bottom, bottom and side, and so on. Also, although the antenna shape being constructed may be tuned for best response at a particular frequency or frequency range, it is also contemplated that the same system may be used to create a detuned structure, e.g., for shielding and so on.

As can be seen, the array of electrodes allows the liquid metal to be drawn into any number of patterns. Moreover, although the liquid metal reservoir allows an electrical connection to be made to the configured shape, e.g., to drive it with an RF signal, the electrodes themselves may also be used, once shaping is complete, to supply a driving signal to an isolated element of the pattern. Thus, as shown in FIG. 3, a pattern 300 that includes isolated elements 301, 303 may be driven via the respective electrodes 305, 307, 309, 311 underlying the elements 301, 303.

Figure 4:
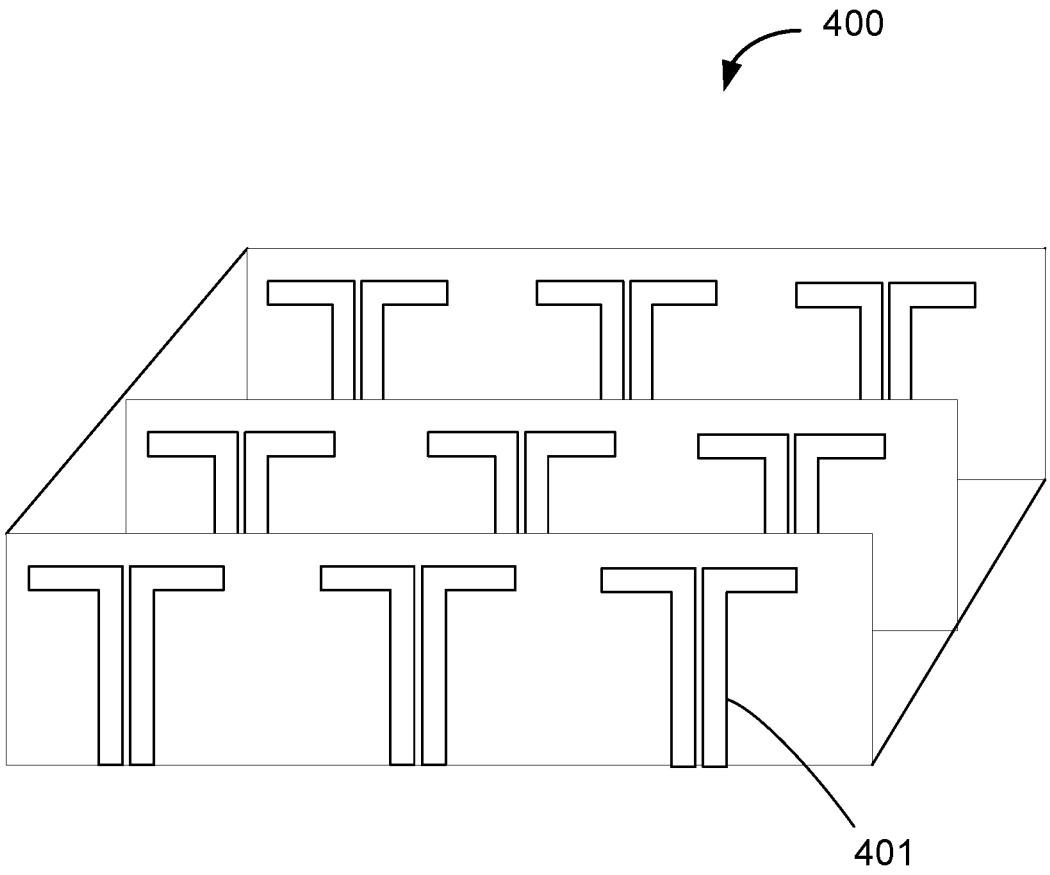
FIG. 4 is a perspective view of a three-dimensional antenna array formed in accordance with an embodiment of the disclosed principles.
Figure 6:
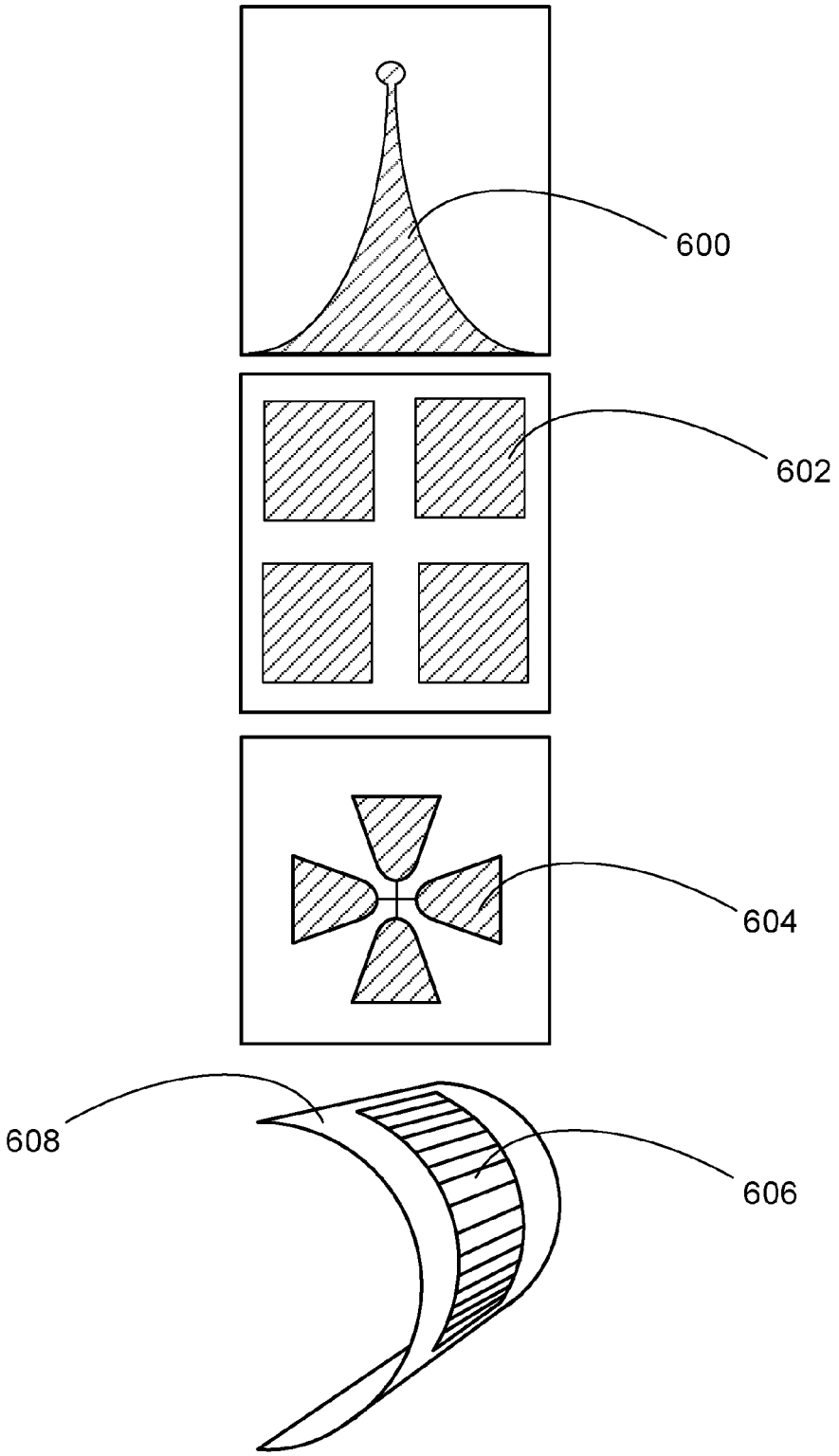
FIG. 6 is a plan view of several additional antenna types created in various embodiments of the disclosed principles as well as a perspective side view of an alternative antenna type.

Many antenna shapes and arrays can be formed using the disclosed principles. A simple monopole configuration has been shown, and the example array 400 shown in FIG. 4 includes many repeated elements 401 and is an example of a three-dimensional dipole array, and may also be a phased array. In addition to the monopole and dipole configurations, other antenna shapes that are usable alone or in two or three-dimensional arrays include Vivaldis 600, patches 602, and bowties 604, as shown in FIG. 6, as well as any other desired antenna shape. Although the illustration of FIG. 4 shows a three-dimensional array made up of individual two-dimensional arrays, an array itself may also be three-dimensional, either by curving or bending in a shape, e.g., an aircraft exterior surface or the like, or by incorporating additional lines of electrodes that rise out of an otherwise planar array. An example of a curved antenna is antenna 606 of FIG. 6. The illustrated curved antenna 606 is a patch antenna conformed to a curved surface 608, but it will be appreciated that any shape of antenna or antenna array may be created on a curved surface using the disclosed principles.

Figure 3:
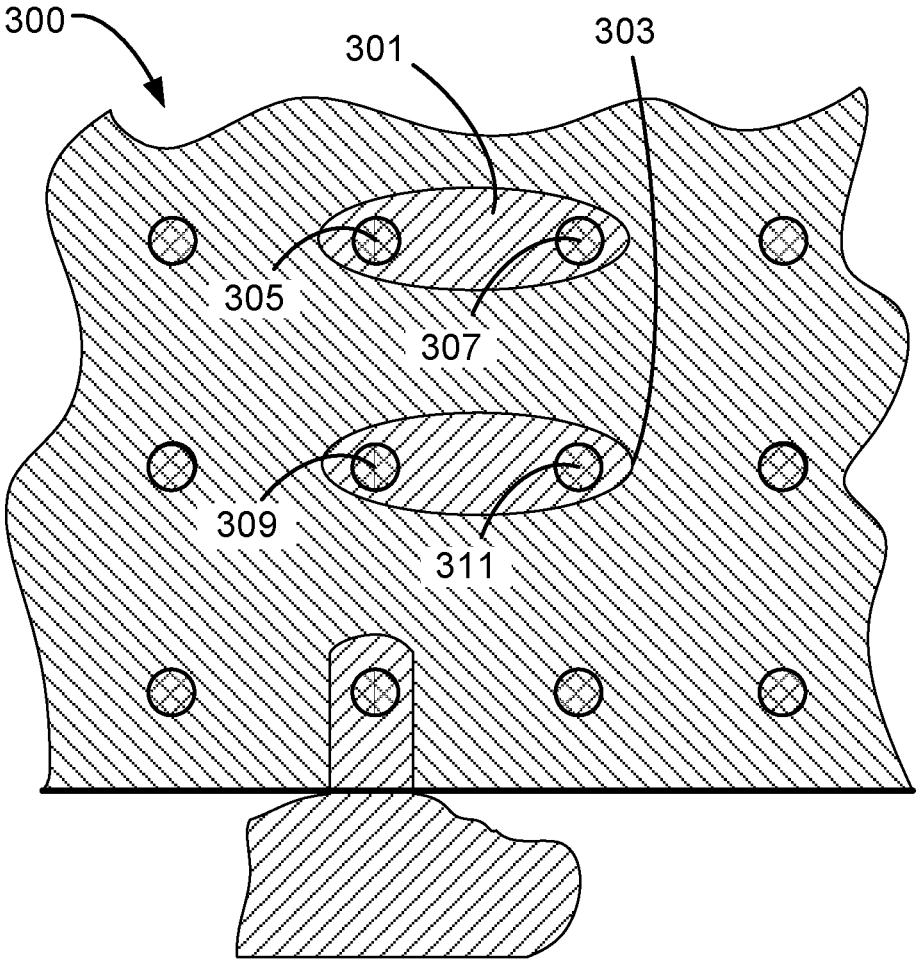
FIG. 3 is a plan view schematic showing a multi-element two dimensional reconfigurable antenna in accordance with an embodiment of the disclosed principles.

In implementation, the electrode array, e.g., the array shown in FIG. 3, includes a top plane and a bottom plane (105 and 106 in FIG. 1) which provide a flat interior space within which the liquid metal and electrolyte are able to move. The top and bottom planes themselves are preferably nonconductive so as not to interfere with the action of the configured antenna.

It will be appreciated that the ability to configure a metallic layer also provides benefits outside of regular antenna operation. For example, a configurable metallic layer may be used to temporarily shield sensitive components from strong electromagnetic radiation. In an embodiment of the disclosed principles, such a shield uses the electromotive ability to steer liquid metal to form such a shield.

Figure 5:
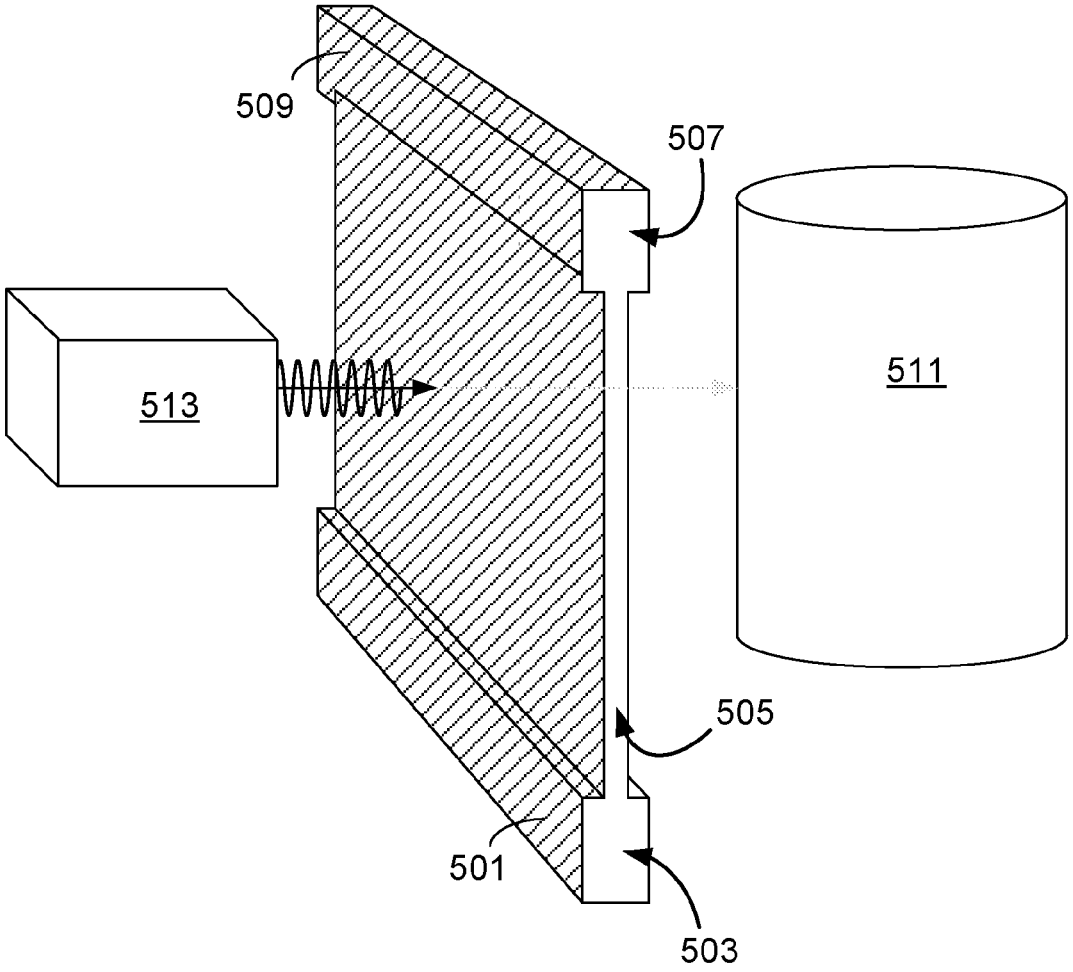
FIG. 5 is a perspective view of a configurable radio frequency (RF) shield system in accordance with an embodiment of the disclosed principles.

An example of this concept is shown in FIG. 5. As can be seen, the liquid metal 501, which may be EGaIn, resides in a liquid metal reservoir 503 beneath a shield cavity 505. The shield cavity 505 contains an array of electrodes (not shown) usable to selectively draw the liquid metal 501 up into the shield cavity 505. The shield cavity 505 is initially filled with an electrolyte 507 such as NaOH, which when displaced flows to an electrolyte reservoir 509. In this way, selective actuation of the electrodes in the shield cavity 505 can be used to shield an RF-sensitive system 511 from an RF source 513. The electrodes may be left free-floating with respect to voltage after the shaping step in order to allow full shielding of the RF-sensitive system 511. It will be appreciated that the electromagnetic shield may instead be configured as an iris or aperture rather than as a curtain depending upon the details of a given installation environment.

With respect to many embodiments it will be appreciated that the resultant current flow of an applied voltage may be measured, e.g., by voltage source 115 or otherwise, to determine the progress of the metal flow and to adaptively adjust the applied voltage (or the location at which voltage is applied) in response. In this context, it is the presence or absence of non-trivial current flow rather than its precise magnitude that reflects the configuration of the liquid metal circuit. For example, when the liquid metal is being driven between a first contact and a second contact via a voltage applied across those contacts, and has not yet touched the second contact, the resultant current will be limited to the minor current allowed through the NaOH.

Once the liquid metal touches the second contact however, the circuit between the two contacts will be shorted, resulting in a current flow increase of an order of magnitude or more (while the voltage is held). In this way, the location of the leading edge of the metal can be determined and a third contact energized (and the second contact grounded or left floating) to extend the metal path in whatever direction is desired from that point onward. The current between the second and third contacts will then be used to determine when the leading edge of the liquid metal reaches the third contact and so on.

Although the various embodiments described above have used the term "electrode" to describe elements providing a source of electrical potential or current, there is no intent to distinguish such an element from an anode, and the electrodes described herein may provide any desired magnitude and polarity of voltage. Moreover, there is no intent to limit the electrode shape to a rod or disc. In particular, it will be appreciated that an electrode for use within the described principles may also be formed in the shape of all or a portion of a desired antenna shape and that the electrode so formed may be of a screen or mesh construction if desired.

While the gap between the top plane and bottom plane have not been specified, it will be appreciated that the metal meniscus and surface tension are beneficial forces in the actions described herein, which are partially capillary driven. As such, gaps of about 1.0 millimeter are contemplated, although other gap sizes are usable as well.

Although NaOH has been used as the electrolyte in the examples herein, it will be appreciated that other electrolytes such as HCL (Hydrochloric acid) and $H_2SO_4$ (Sulfuric acid) and others may be used instead as long as they allow sufficient conductivity without impeding the operation of the formed antenna. Moreover, although the examples herein use EGaIn as the liquid metal, it will be appreciated that other liquid metals may be used, e.g., pure Gallium, other alloys of Gallium, Mercury and Mercury alloys. Other liquid metals such as Francium, Rubidium and Cesium are generally less preferred due to other constraints such as cost, toxicity and so on. However, if these aspects are suitably accounted for then even these additional metals may also be used within the described principles.

Figure 7:
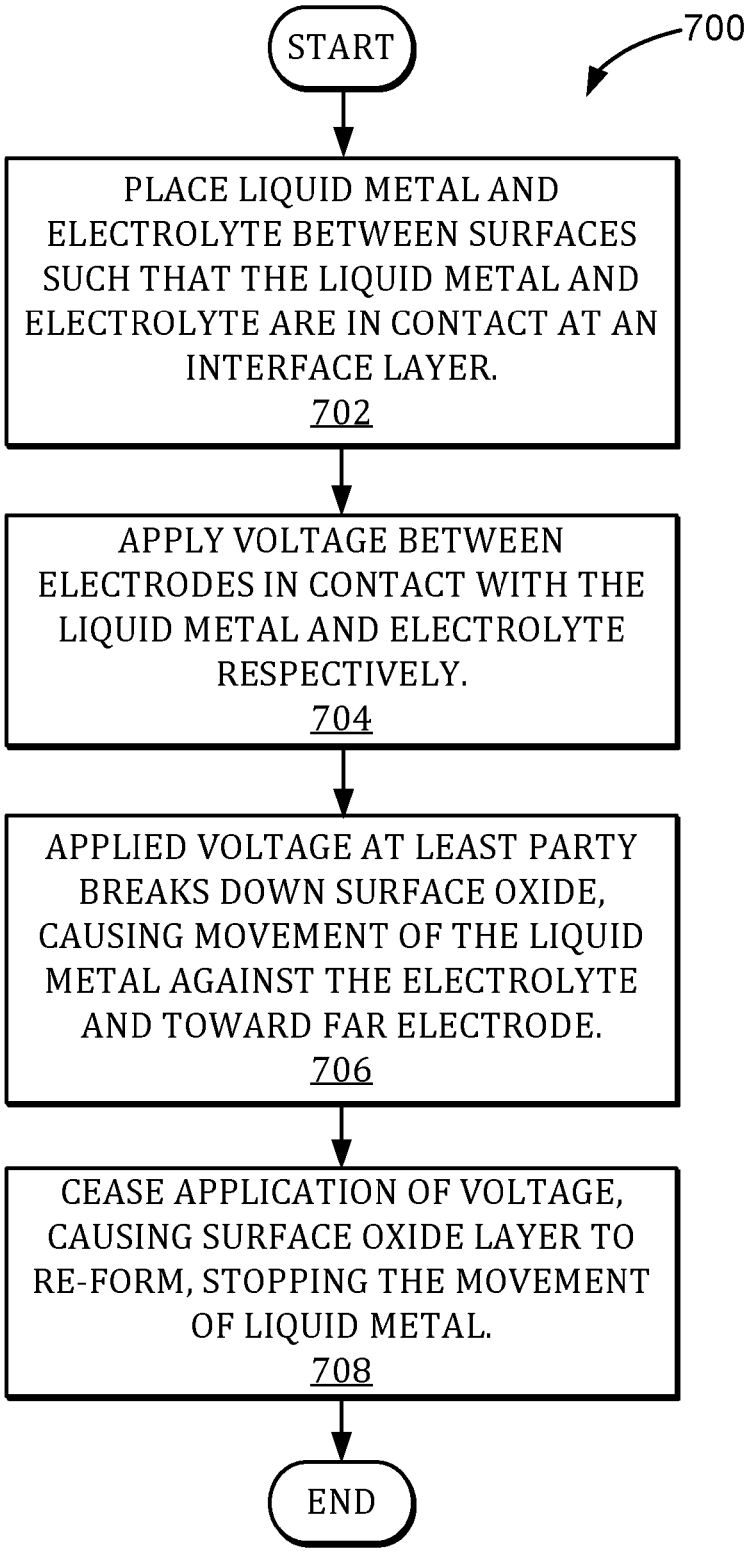
FIG. 7 is a flow chart illustrating an exemplary process of configuring a liquid metal reconfigurable antenna in accordance with one or more embodiments of the disclosed principles.

It will be appreciated that the described principles may be applied in many applications and in many ways. As such, there is no attempt made to describe every such manner of use. However, the flow chart FIG. 7 does illustrate an example process 700 of configuring a liquid metal reconfigurable antenna in accordance with one or more embodiments of the disclosed principles.

At stage 702 of the process 700, a liquid metal 205 and an electrolyte 209 are placed between two surfaces 105, 106 such that the liquid metal 205 and the electrolyte 209 are in contact at an interface layer 108 which includes a surface oxide (e.g., an oxide of EGaIn in the example system). At stage 704, a voltage 113 is applied between electrodes 107, 111 which are in contact with the liquid metal 205 and the electrolyte 209 respectively.

At stage 706, the applied voltage at least party breaks down the surface oxide and thus, via capillary action, causes movement of the liquid metal 205 against the electrolyte 209 toward the far electrode 111. At this point, either of two mechanisms can halt the advance of the liquid metal 205. First, if the application of voltage is stopped or reversed, the liquid metal 205 will no longer advance. Second, if the liquid metal is allowed to reach the far electrode 111, the liquid metal 205 will stop its movement until a further electrode is energized. For the example process 700, it is assumed that the liquid metal is to be stopped at some point midway between electrodes.

Thus, at stage 708, the application of voltage 113 is ceased, causing the surface oxide layer to re-form and stopping the movement of the liquid metal. This final state, e.g., as shown in the second configuration 213 of the liquid metal 205 in FIG. 2, matches a desired predetermined configuration. However, further manipulations of the liquid metal via the same steps but with different far electrodes will yield any desired configuration, such as any of the antenna configurations shown in FIG. 6.

It will be appreciated that systems and techniques for reconfiguring electromagnetic antennae have been disclosed herein. However, in view of the many possible embodiments to which the principles of the present disclosure may be applied, it should be recognized that the embodiments described herein with respect to the drawing figures are meant to be illustrative only and should not be taken as limiting the scope of the claims. Therefore, the techniques as described herein contemplate all such embodiments as may come within the scope of the following claims and equivalents thereof.

We claim:

1. A selectively reconfigurable antenna system (100), comprising:

a first material layer (105) and a second material layer (106) defining a cavity (104) there between;

a first reservoir (207) and a liquid metal (205) at least partially in the first reservoir;

a second reservoir (215) and a liquid electrolyte (209) at least partially in the second reservoir such that the liquid metal and the electrolyte are in contact at a metal oxide layer (108) in the cavity; and a plurality of electrodes (107, 111, and 203) in electrical communication with the cavity, with a first electrode (107) being in contact with the liquid metal and a second electrode (111) being in contact with the electrolyte such that the metal oxide layer breaks down when a negative potential (113) is applied to the second electrode relative to the first electrode.

2. The system in accordance with claim 1, wherein the liquid metal is attracted to the second electrode by virtue of the negative potential thereof.

3. The system in accordance with claim 1, wherein a first portion (211) of the plurality of electrodes is attached to the first material layer and a second portion (203) of the plurality of electrodes is attached to the second material layer.

4. The system in accordance with claim 1, wherein the liquid metal comprises one of Gallium and Mercury.

5. The system in accordance with claim 4, wherein the liquid metal comprises a eutectic alloy of Gallium and Indium "EGaIn".

6. The system in accordance with claim 1, wherein the electrolyte is sodium hydroxide "NaOH".

7. The system in accordance with claim 1, further comprising a liquid metal structure (401, 600, 602, 604, 606) within the cavity formed by selectively breaking the oxide layer and moving the liquid metal via the application of potential between at least one pair of the electrodes.

8. The system in accordance with claim 7, wherein the liquid metal structure is one of a curtain, a window, an aperture, a frequency-selective surface, and a thermal sink.

9. The system in accordance with claim 7, wherein the liquid metal structure comprises at least one of a monopole antenna, a dipole antenna, a Vivaldi horn element, a bowtie element, and a patch element.

10. The system in accordance with claim 1, wherein the first and second material layers are planar.

11. The system in accordance with claim 1, wherein the first and second material layers conform to a curved surface (608).

12. The system in accordance with claim 11, wherein the curved surface in an aircraft outer mold line.

13. The system in accordance with claim 1, wherein at least one of the plurality of electrodes is an electrical connector (211) linked to the liquid metal at an edge of the cavity.

14. The system in accordance with claim 13, wherein the electrical connector is an elongate shape (211) configured to contact the liquid metal internally with respect to any surface layer.

15. A phased array (400) comprising a plurality of the selectively reconfigurable antenna systems according to claim 1.

16. A method (700) of configuring an antenna, the method comprising:

placing (702) a liquid metal (205) and an electrolyte (209) between two surfaces (105, 106) such that the liquid metal and the electrolyte are in contact at an interface layer (108) which includes a surface oxide;

initiating (704) application of a voltage (113) between the electrolyte and a portion of the liquid metal to generate an electric field at the interface layer, at least party breaking down (706) the surface oxide and causing movement of the portion of the liquid metal toward the electrolyte; and ceasing (708) application of the voltage between the electrolyte and the portion of the liquid metal to freeze the interface layer in place when the liquid metal reaches a predetermined configuration.

17. The method in accordance with claim 16, wherein the interface layer is an oxide of the liquid metal.

18. The method in accordance with claim 17, wherein the application of the voltage breaks down the interface layer.

19. The method in accordance with claim 16, wherein the liquid metal comprises Gallium and the electrolyte comprises sodium hydroxide "NaOH".

20. The method in accordance with claim 16, wherein ceasing application of the voltage between the electrolyte and the portion of the liquid metal causes the surface oxide layer to re-form.

21. A reconfigurable antenna (401, 600, 602, 604, 606) comprising:

a liquid metal (205) in contact with an electrolyte (209) and being in a first configuration (206);

a plurality of electrodes (203, 211) including a first electrode (211) in contact with the liquid metal and a second electrode (203) in contact with the electrolyte; and a voltage source (115) connected across the first and second electrodes and configured to apply a voltage (113) of a predetermined magnitude and a predetermined polarity in order to move the liquid metal from the first configuration to a second configuration and to measure resultant current flow and modify the applied voltage based on the resultant current flow.

22. The antenna of claim 21, wherein cessation of the applied voltage locks the liquid metal in the second configuration.

23. The reconfigurable antenna of claim 21, wherein at least one of the first configuration and the second configuration is a two-dimensional configuration.

* * * * *